US006352331B1

(12) United States Patent
Armijo et al.

(10) Patent No.: US 6,352,331 B1
(45) Date of Patent: Mar. 5, 2002

(54) DETECTION OF NON-FIRING PRINTHEAD NOZZLES BY OPTICAL SCANNING OF A TEST PATTERN

(75) Inventors: Chris T. Armijo, San Diego, CA (US); Gonzalo Gaston, Sant Cugat del Vallès (ES); Javier Lagares, Sant Cugat del Vallès (ES); Antoni Gil, Sant Cugat del Vallès (ES); Francesc Subirada, Sant Cugat del Valles (ES); Francisco Guerrero, Sant Cugat del Valles (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 08/811,412

(22) Filed: Mar. 4, 1997

(51) Int. Cl.[7] ..... B41J 29/393; B41J 3/00; B41J 2/195; B41J 29/38

(52) U.S. Cl. ..... 347/19; 347/2; 347/7; 347/14

(58) Field of Search ..... 347/19, 7, 2, 40, 347/14, 59, 17, 58, 67, 43, 37, 49, 87

(56) References Cited

U.S. PATENT DOCUMENTS

| | | | | |
|---|---|---|---|---|
| 4,977,459 A | | 12/1990 | Ebinuma | |
| 5,109,239 A | * | 4/1992 | Cobbs et al. | 347/40 |
| 5,448,269 A | | 9/1995 | Beauchamp | |
| 5,508,826 A | * | 4/1996 | Lloyd et al. | 347/19 |

FOREIGN PATENT DOCUMENTS

| | | | | |
|---|---|---|---|---|
| DE | 3246707 | | 6/1984 | B41J/3/04 |
| EP | 0500281 A2 | | 8/1992 | B41J/2/165 |
| JP | 57-110455 | * | 7/1982 | 347/19 |
| JP | 58-162350 | * | 9/1983 | 347/19 |
| JP | 63-260448 | * | 10/1988 | 347/19 |
| JP | 2-194955 | * | 8/1990 | 347/19 |
| JP | 03104678 | | 5/1991 | B41J/29/46 |
| JP | 04169239 | | 6/1992 | B41J/2/175 |
| JP | 06024008 | | 2/1994 | B41J/2/21 |

* cited by examiner

*Primary Examiner*—John Barlow
*Assistant Examiner*—Charles W. Stewart, Jr.

(57) ABSTRACT

A nozzle detection test pattern has been developed which can be sensed by an optical sensor located on an inkjet printer carriage. By having the same nozzle print ink drops on multiple pixels to form a single thickened test line during multiple passes of the printhead, it is possible to thereafter scan across such test line and automatically determine by the light contrast ratios which nozzles are not firing properly. A green light LED is used to illuminate the magenta, cyan and black test patterns as they are being sensed, and a blue light LED is used to illuminate the yellow test pattern as it is being sensed. A separate test pattern is used for each printhead ink color. The test pattern constitutes six rows with forty test lines on each row for a printhead having 240 active nozzles.

24 Claims, 11 Drawing Sheets

DETECTION OF NON-FIRING PRINTHEAD NOZZLES BY OPTICAL SCANNING OF A TEST PATTERN

CROSS-REFERENCE TO RELATED APPLICATIONS

This application is related to the following commonly assigned co-pending applications which are incorporated herein by reference: U.S. Patent 6,076,913 entitled OPTICAL ENCODING OF PRINTHEAD SERVICE MODULE filed concurrently on Mar. 4, 1997; as Ser. No. 811,406; allowed U.S. Pat. application entitled DYNAMIC MULTI-PASS PRINT MODE CORRECTIONS TO COMPENSATE FOR MALFUNCTIONING INKJET NOZZLES filed concurrently on Mar. 4, 1997; as Ser. No. 810,467; and U.S. Patent 5,975,674 entitled OPTICAL PATH OPTIMIZATION FOR LIGHT TRANSMISSION AND REFLECTION IN A CARRIAGE-MOUNTED INKJET PRINTER SENSOR filed Oct. 31, 1995 as Ser. No. 551,022.

BACKGROUND OF THE INVENTION

Various techniques have been used in the past to detect which inkjet printhead nozzles are functioning satisfactorily, and then doing recovery procedures to re-activate nozzles prior to doing a printout. In today's printer world, throughput and print quality are somewhat contradictory goals. Nevertheless it may be possible to achieve both goals with a simple technique for monitoring nozzle functionality.

BRIEF SUMMARY OF THE INVENTION

A nozzle detection test pattern has been developed which can be sensed by an optical sensor located on an inkjet printer carriage. By having the same nozzle print ink drops on multiple pixels to form a single thickened test line or module of a test pattern, during multiple passes of the printhead, it is possible to thereafter scan across such test line and automatically determine by the light contrast ratios which nozzles are not firing properly. A green light LED is used to illuminate magenta, cyan and black test patterns as they are being sensed, and a blue light LED is used to illuminate a yellow test pattern as it is being sensed. A separate test pattern is used for each printhead ink color. The test pattern constitutes six rows with forty test lines or modules on each row for a printhead having 240 active nozzles.

DETAILED DESCRIPTION OF PREFERRED EMBODIMENT

In accordance with the foregoing objects, the invention provides a method of monitoring and controlling the quality of pen markings on a plotting medium by optically sensing across a sample line or test-pattern module drawn on an actual medium.

In another separate and important aspect of the invention, a customized optical sensor is provided for monitoring plotter performance by sensing the quality of lines drawn on a medium. An LED emitting a green light beam is angularly directed toward an underlying line so as to reflect into an optical sensor which measures the print contrast ratio of a point on the line. Circuit means amplify and filter the signal generated by the optical sensor.

Thus, by appropriate selection of the wavelength of the light used for sensing the markings on the medium, it is easily possible to check multicolor drawings for correct quality and colors.

In a presently preferred embodiment of the invention implemented in a color inkjet printer/plotter, a green LED is used for sensing sample patterns printed by each of the black (K), cyan (C) and magenta (M) printheads, while a blue LED is used for sensing sample patterns printed by the yellow (Y) printhead.

Moreover, a light tube on a carriage-mounted optical sensor has inner walls which help direct light from an LED toward an area surrounding a point under the sensor, and outer walls which help block out undesirable external light from being reflected from the area surrounding a point under the sensor into the photocell.

Thus, the invention contemplates optical sensing of different color markings on media using different color light, and raster "lines" (i.e. bars) printed on a pixel grid by an inkjet printer/plotter.

Figure 1:
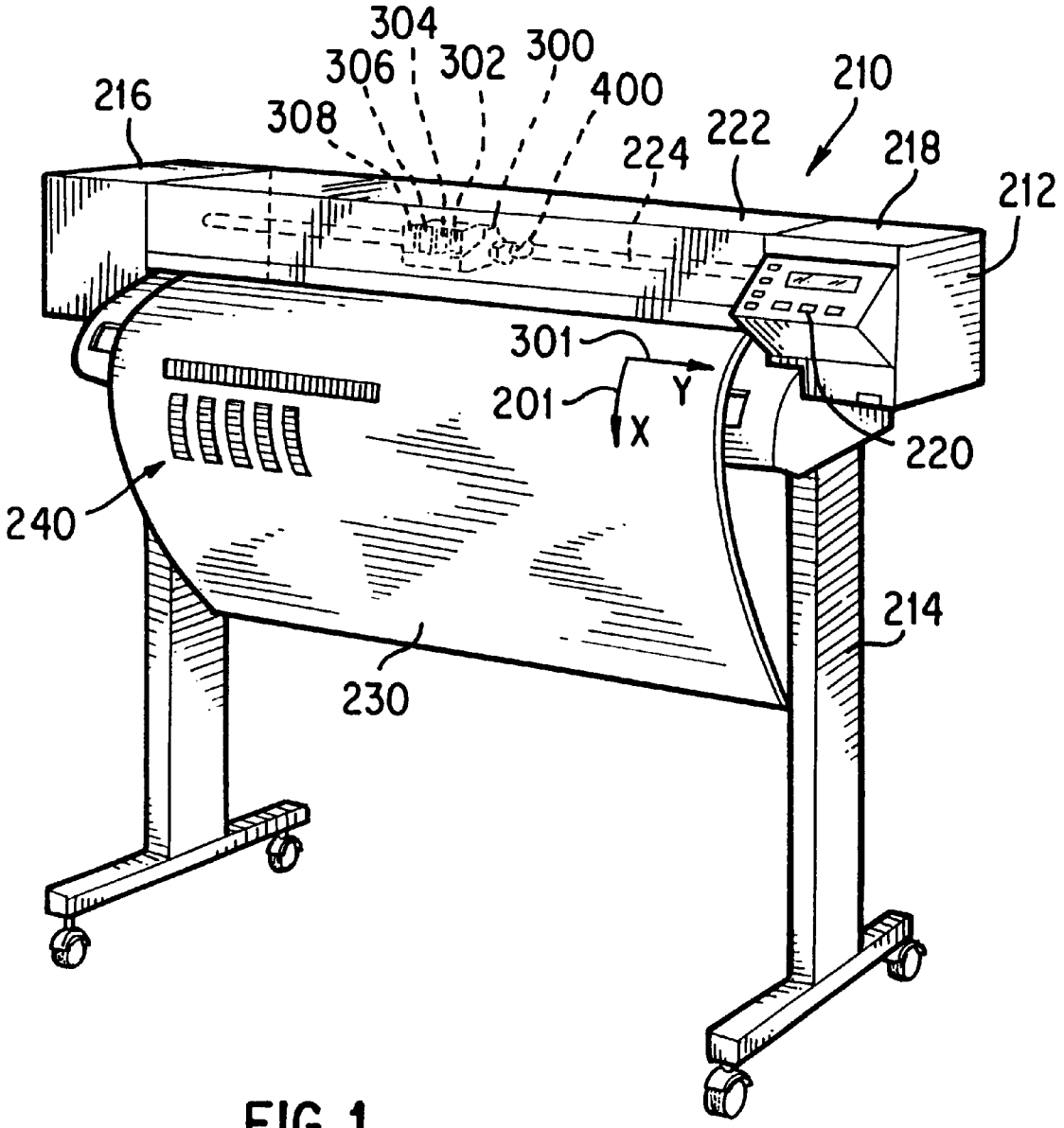
FIG. 1 is a perspective view of a large format inkjet printer/plotter incorporating the features of the present invention.
Figure 2:
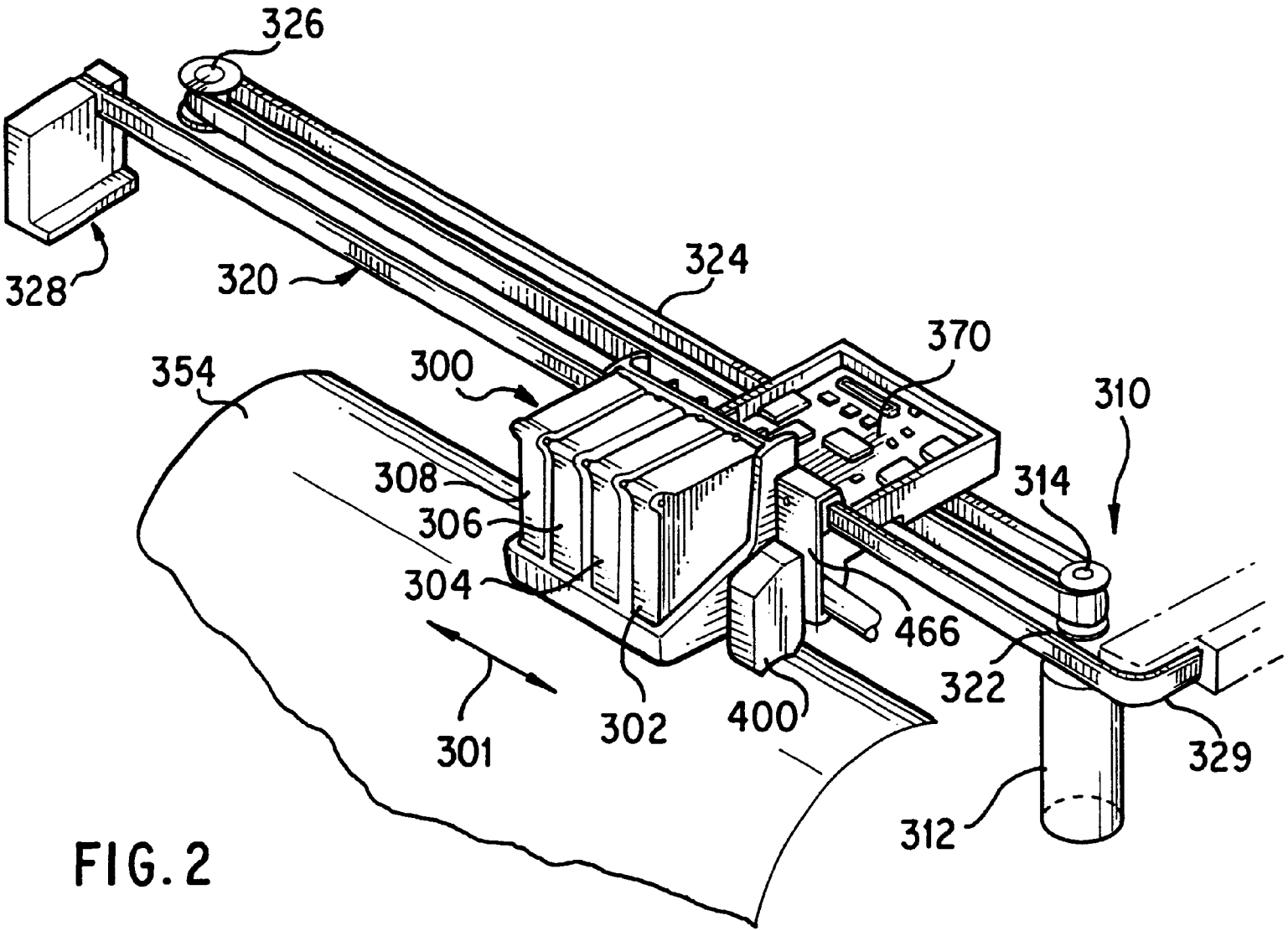
FIG. 2 is a close-up view of the carriage portion of the printer/plotter of FIG. 1 showing a carriage-mounted optical sensor of the present invention.

A typical embodiment of the invention is exemplified in a large format color inkjet printer/plotter as shown in FIGS. 1 and 2. More specifically, FIG. 1 is a perspective view of an inkjet printer/plotter 210 having a housing 212 mounted on a stand 214. The housing has left and right drive mechanism enclosures 216 and 218. A control panel 220 is mounted on the right enclosure 218. A carriage assembly 300, illustrated in phantom under a cover 222, is adapted for reciprocal motion along a carriage bar 224, also shown in phantom. The position of the carriage assembly 300 in a horizontal or carriage scan axis is determined by a carriage positioning mechanism 310 with respect to an encoder strip 320 (see FIG. 2). A print medium 330 such as paper is positioned along a vertical or media axis by a media axis drive mechanism (not shown). As used herein, the media axis is called the X axis denoted as 201, and the scan axis is called the Y axis denoted as 301.

FIG. 2 is a perspective view of the carriage assembly 300, the carriage positioning mechanism 310 and the encoder strip 320. The carriage positioning mechanism 310 includes a carriage position motor 312 which has a shaft 314 which drives a belt 324 which is secured by idler 326 and which is attached to the carriage 300.

The position of the carriage assembly in the scan axis is determined precisely by the encoder strip 320. The encoder strip 320 is secured by a first stanchion 328 on one end and a second stanchion 329 on the other end. An optical reader (not shown) is disposed on the carriage assembly and provides carriage position signals which are utilized by the invention to achieve optimal image registration in the manner described below.

Figure 3:
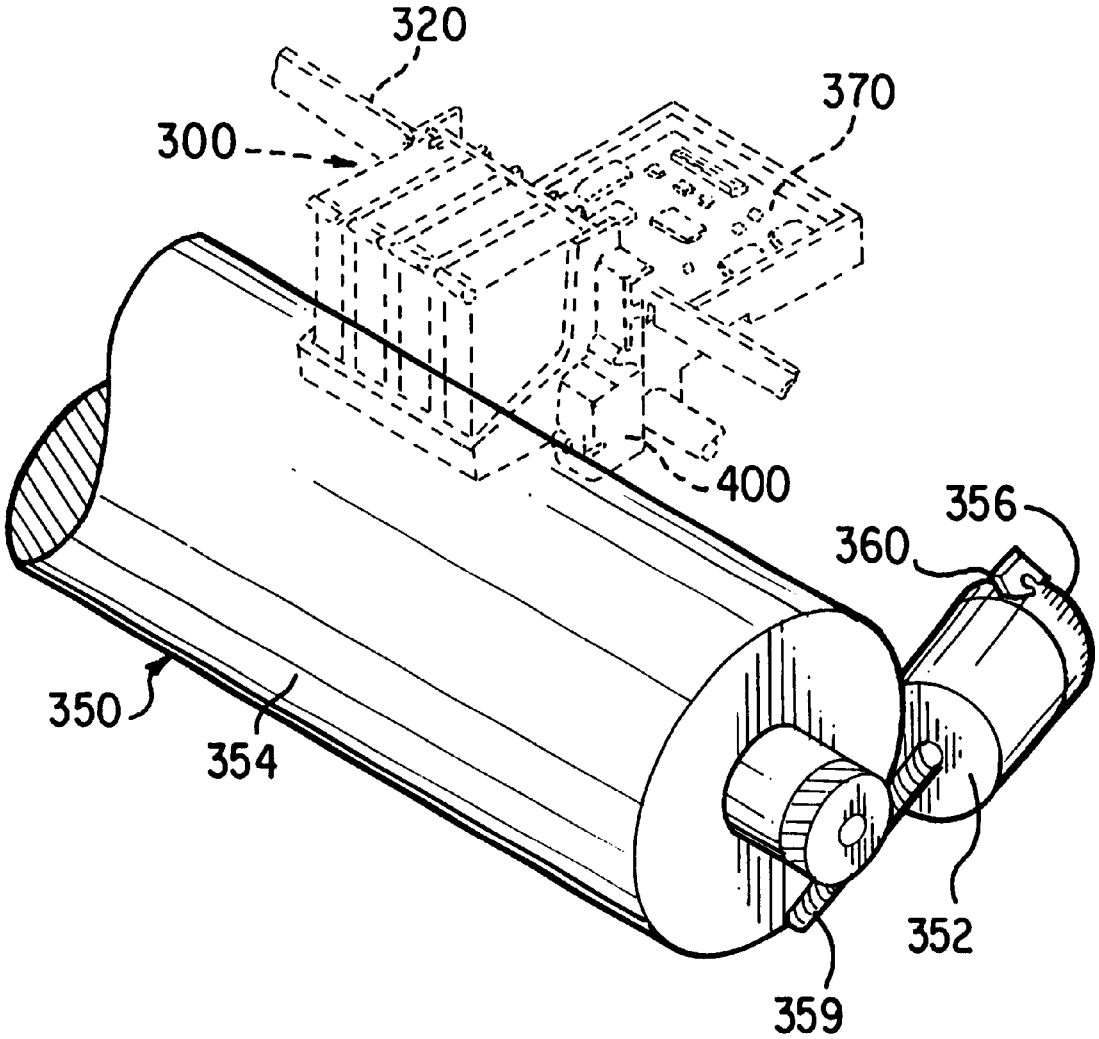
FIG. 3 is a close-up view of the platen portion of the printer/plotter of FIG. 1 showing the carriage portion in phantom lines.

FIG. 3 is perspective view of a simplified representation of a media positioning system 350 which can be utilized in the inventive printer. The media positioning system 350 includes a motor 352 which is normal to and drives a media roller 354. The position of the media roller 354 is determined by a media position encoder 356 on the motor. An optical reader 360 senses the position of the encoder 356 and provides a plurality of output pulses which indirectly determines the position of the roller 354 and, therefore, the position of the media 230 in the X axis.

The media and carriage position information is provided to a processor on a circuit board 370 disposed on the carriage assembly 100 for use in connection with printhead alignment techniques of the present invention.

The printer 210 has four inkjet print cartridges 302, 304, 306, and 308 that store ink of different colors, e.g., black, magenta, cyan and yellow ink, respectively. As the carriage assembly 300 translates relative to the medium 230 along the X and Y axes, selected nozzles in the inkjet print cartridges 302, 304, 306, and 308 are activated and ink is applies to the medium 230. The colors from the three color cartridges are mixed to obtain any other particular color. Sample lines 240 are typically printed on the media 230 prior to doing an actual printout in order to allow the optical sensor 400 to pass over and scan across the lines as part of the initial calibration.

The carriage assembly 300 positions the inkjet print cartridges and holds the circuitry required for interface to the ink firing circuits in the print cartridges. The carriage assembly 300 includes a carriage 301 adapted for reciprocal motion on front and rear slider rods 303, 305.

As mentioned above, full color printing and plotting requires that the colors from the individual print cartridges be precisely applied to the media. This requires precise alignment of the carriage assembly as well as precise alignment of the print cartridges in the carriage. Unfortunately, paper slippage, paper skew, and mechanical misalignment of the print cartridges results in offsets in the X direction (in the media advance axis) and in the Y direction (in the carriage or scan axis) as well as angular theta offsets. This misalignment causes misregistration of the print images/graphics formed by the individual ink drops on the media. This is generally unacceptable as multicolor printing requires image registration accuracy from each of the printheads to within 1/1000 (1 mil).

Figure 4:
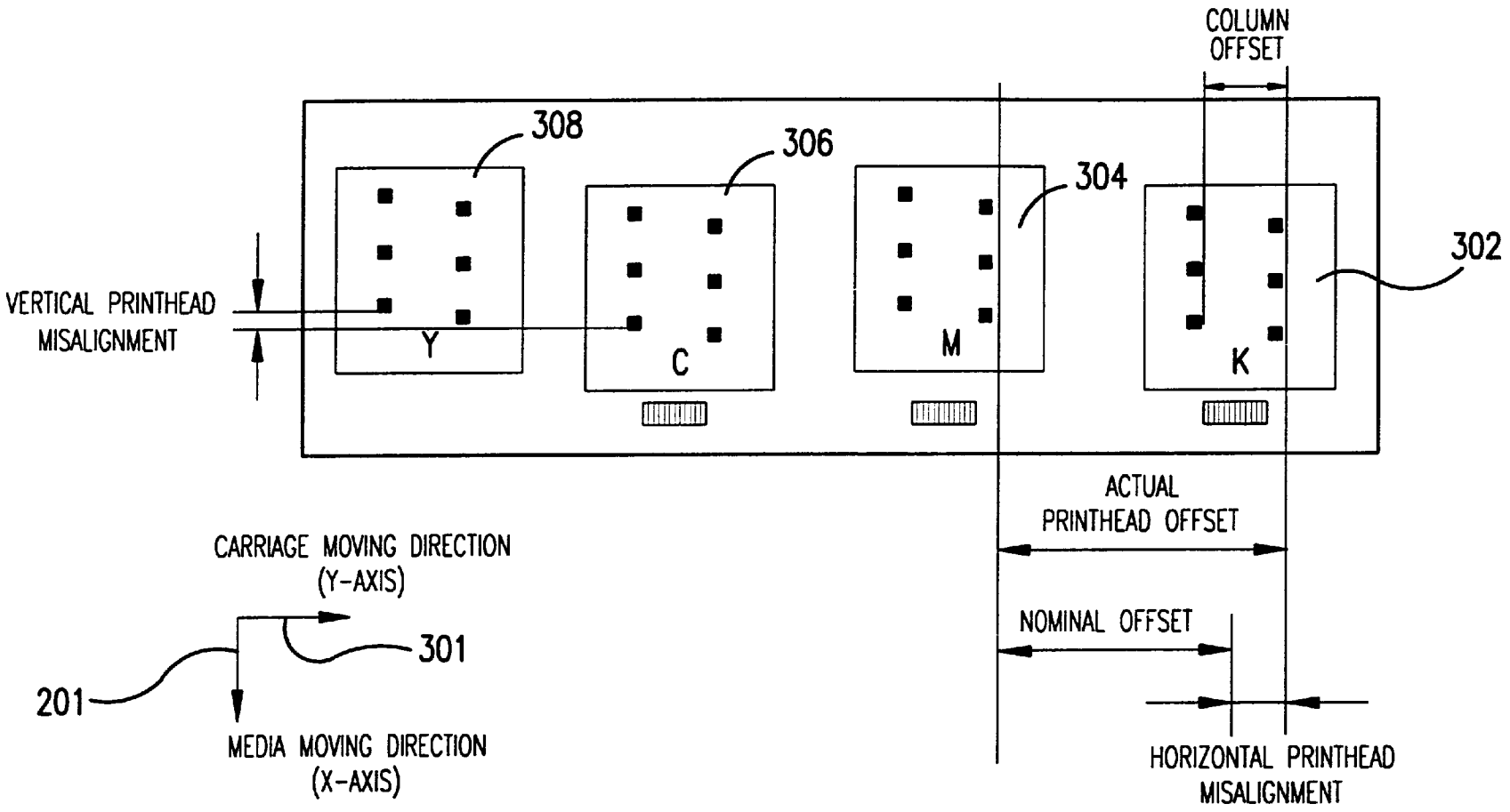
FIG. 4 is a schematic representation of a top view of the carriage showing offsets between individual printheads in the media advance axis and in the carriage scan axis (the phrase "media advance axis" is a shorthand way of referring to the printing-medium advance axis)

FIG. 4 shows a presently preferred embodiment of printheads each having two groups of nozzles with a column offset 410. By comparing the relative positions of corresponding nozzles in different printheads along the Y axis, it is possible to determinine an actual horizontal offset 412 between two printheads, and by comparison with a nominal default offset 414 determine an actual offset 416 in the carriage scan axis. This is repeated for all of the different printheads while they remain on the carriage.

Similarly, by comparing the relative positions of corresponding nozzles in different printheads along the X axis, it is possible to determine ac actual vertical offset 418 in the media advance axis. This is also repeated for all of the different printheads while they remain on the carriage.

Figure 5:
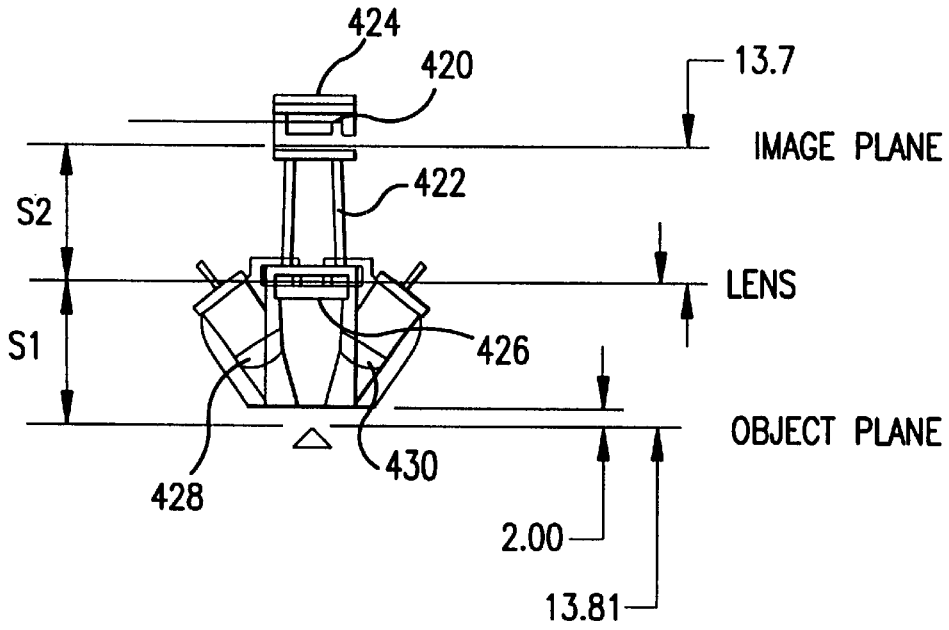
FIG. 5 is a front view of the optical components of the sensor unit of FIG. 4.
Figure 7:
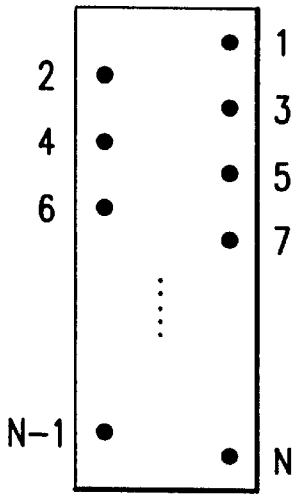
FIG. 7 schematically shows the nozzle plate of a 600 dpi print cartridge having one column of ink-ejection nozzles separated from another column of ink-ejecting nozzles.
Figure 8:
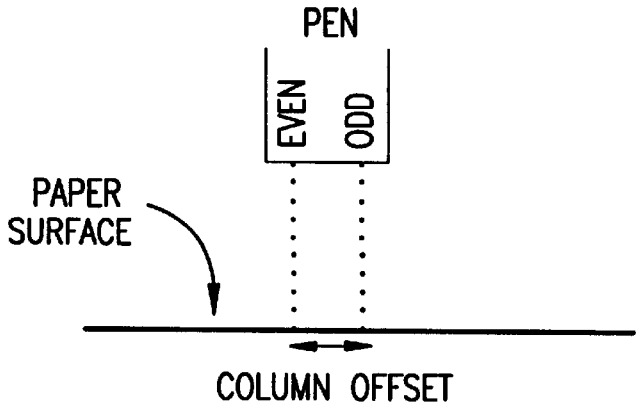
FIG. 8 schematically shows the print cartridge of FIG. 7 in printing position over a print zone.
Figure 6A:
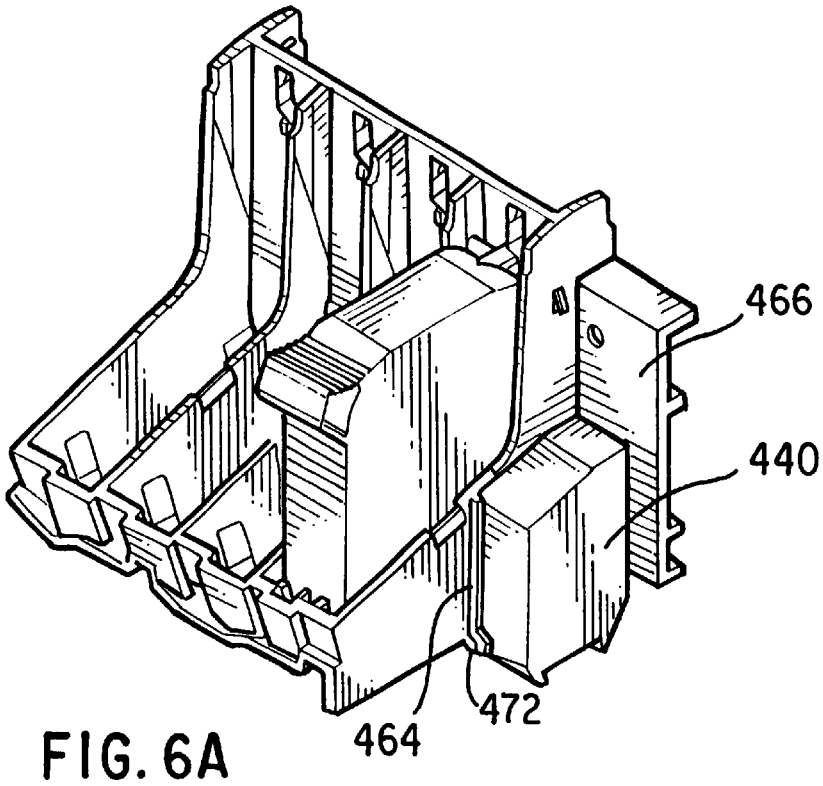
FIGS. 6A and 6B are isometric views respectively looking downwardly and upwardly toward the carriage showing the optical sensor and one print cartridge mounted on the carriage.
Figure 6B:
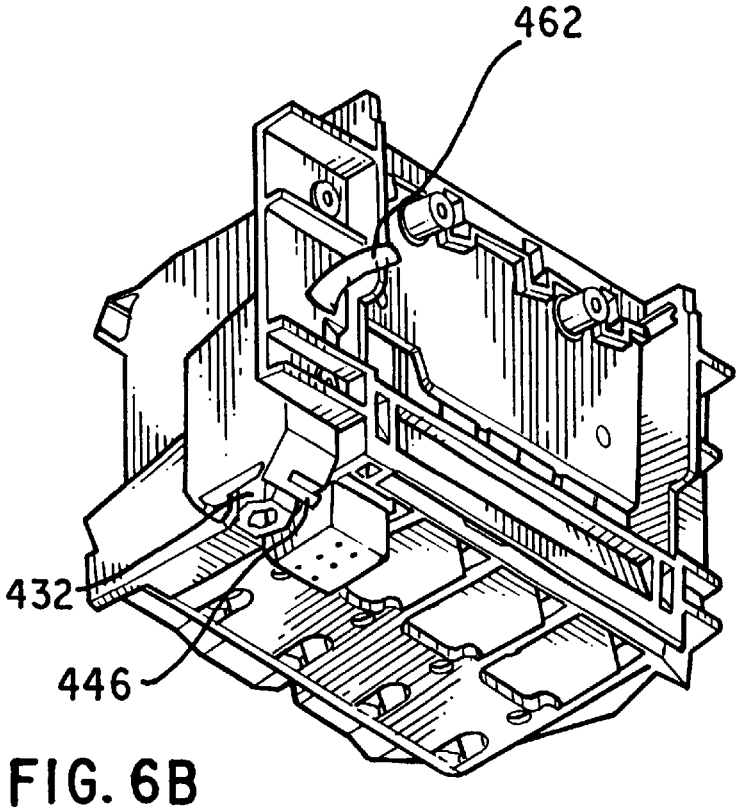

In order to accurately scan across a test pattern line, the optical sensor 400 is designed for precise positioning of all of its optical components. Referring to FIGS. 5, 6A and 6B, the sensor unit includes a photocell 420, holder 422, cover 424, lens 426, and light source such as two LEDs 428, 430. A protective casing 440 which also acts as an ESD shield for sensor components is provided for attachment to the carriage.

Additional details of the function of a preferred optical sensor system and related printing system are disclosed in copending application Ser. No. 08/551,022 filed Oct. 31, 1995 entitled OPTICAL PATH OPTIMIZATION FOR LIGHT TRANSMISSION AND REFLECTION IN A CARRIAGE-MOUNTED INKJET PRINTER SENSOR, which application is assigned to the assignee of the present application, and is hereby incorporated by reference.

Figure 9:
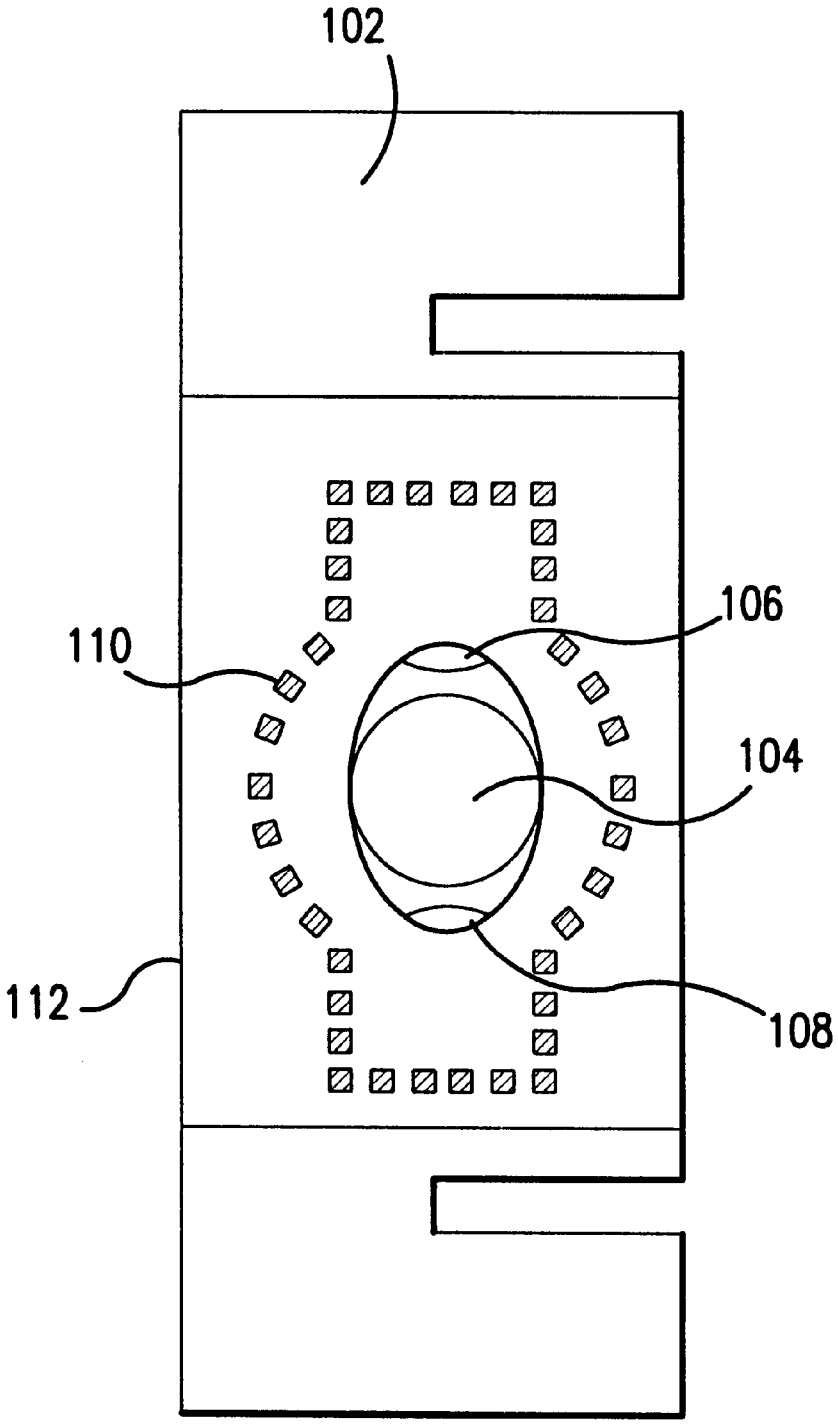
FIG. 9 is a view looking up from the media into a sensor having increased ambient light shielding.

An optical sensor unit having increased shielding against ambient light is shown in FIG. 9, including a housing 102, lenses 104, green light LED 106, and blue light LED 108. The previous external perimeter of the shielding is shown in dotted lines 110, relative to which the new version of an enlarged shielding 112 provides improved optical performance.

Figure 10:
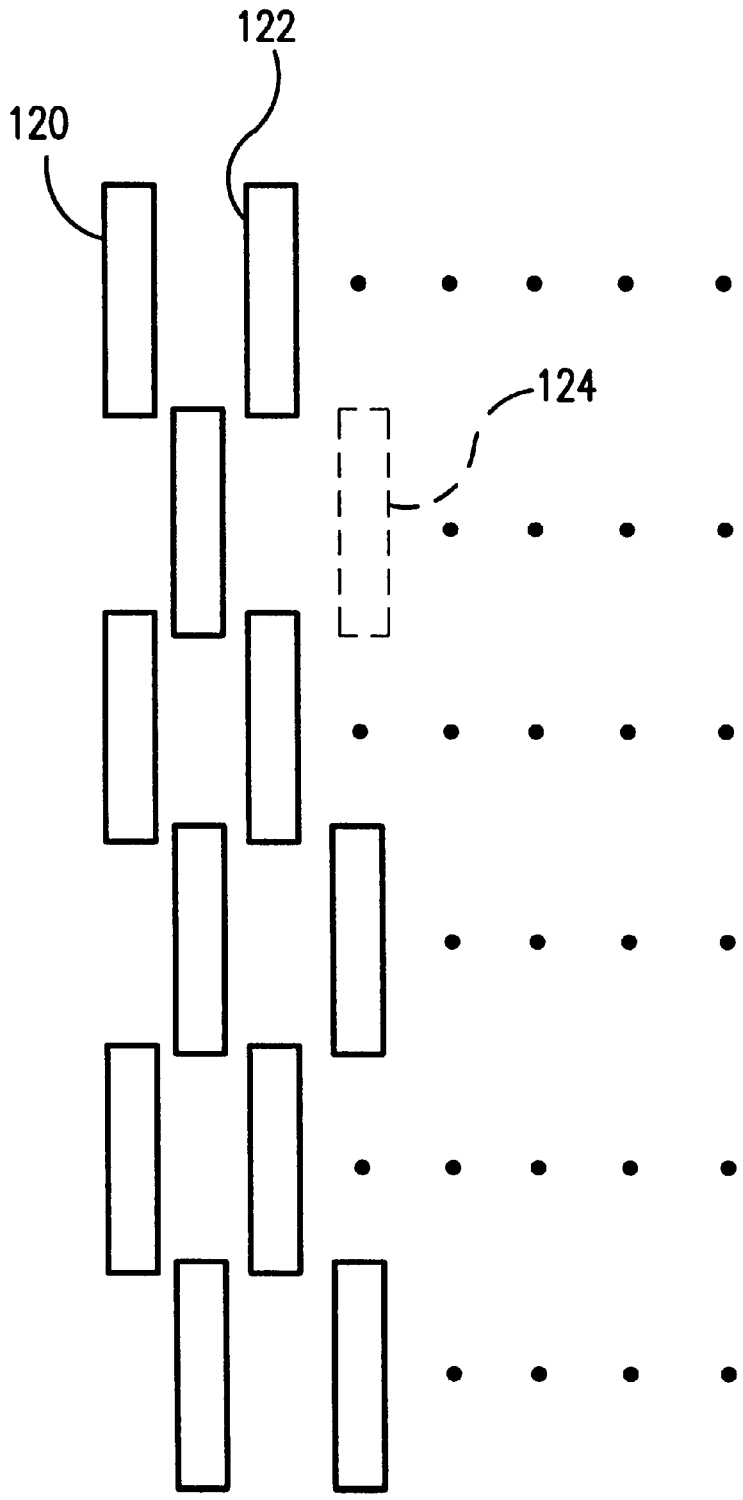
FIG. 10 is a schematic drawing showing greatly enlarged a portion of an exemplary test pattern for nozzle functionality.

The diagram of FIG. 10 shows a preferred arrangement of markings, each group 120, 122, 124 of marks being fired solely by a one particular nozzle respectively during successive multiple passes of the printhead across the printing medium. A two-pixel vertical (x-axis) advance between bidirectional passes across the medium is used to generate the patterns of the printing medium. It is this two-pixel advance that produces the blank pixel rows, between the approximately twenty rows of horizontally adjacent inked pixels seen in the upper portion of FIG. 12. Groups or test pattern modules 120, 122 are represented as being somewhat solid in ink drops from two good nozzles, respectively, while module or group 124 is virtually nonexistent thereby indicating a nonfiring nozzle.

Figure 11:
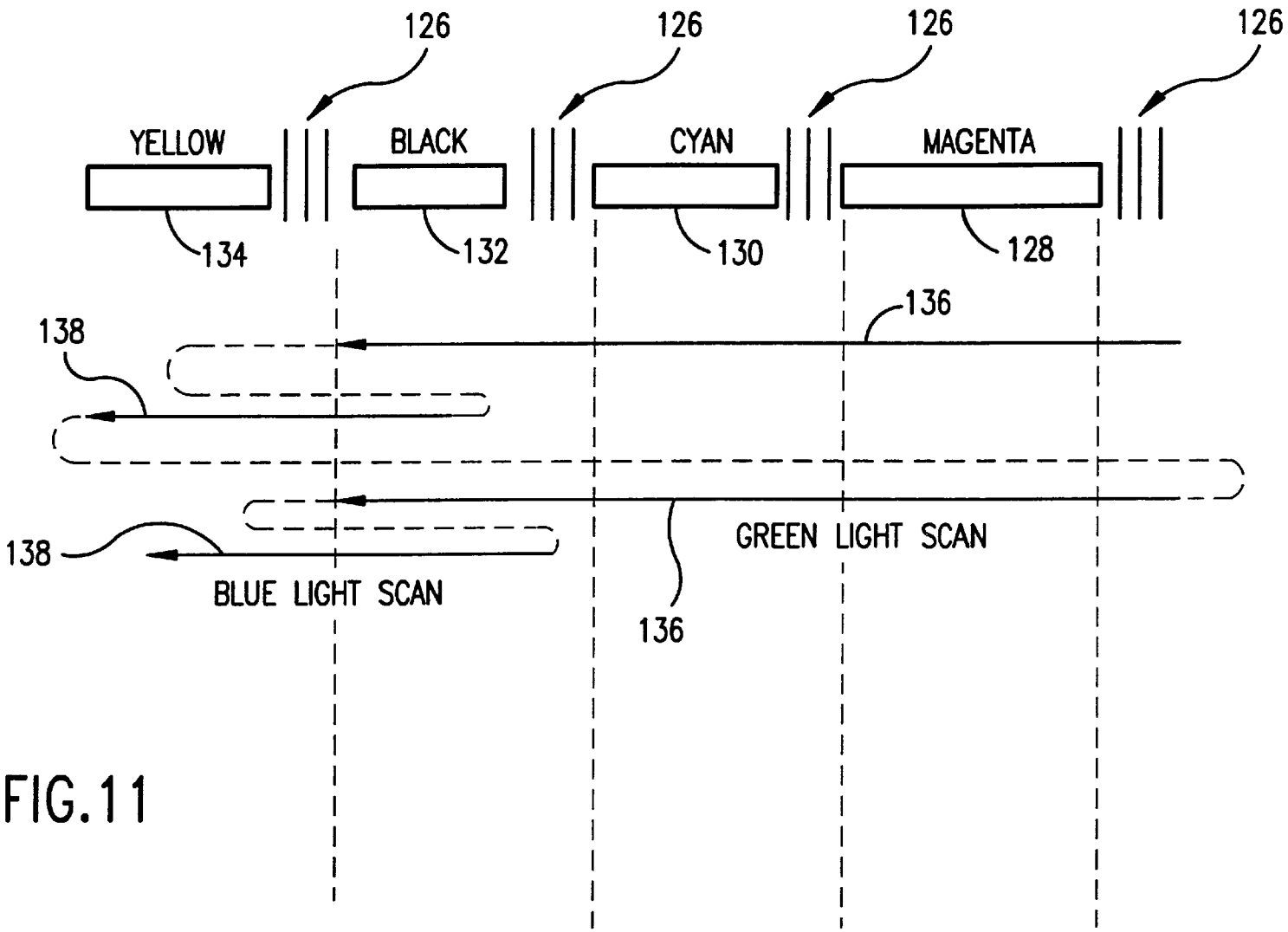
FIG. 11 is a schematic drawing showing a presently preferred scanning technique for a nozzle-out test pattern.

FIG. 11 shows a preferred sequence of sensor scanning, with six complete one-way scans being sufficient to pass over 240 separate test-pattern modules or groups of markings representing output from 240 individual nozzles, respectively. The green light is used for illumination of the magenta, cyan and black patterns during optical sensing, while a blue light is used for illumination of the yellow pattern (sometimes printed against a cyan background for better contrast). Because the contrast sensed for the yellow test pattern is much weaker than for the other colors, it was found preferable to use a separate stronger amplification circuit for the yellow patterns in order to provide the same performance as with the other color inks.

Figure 12:
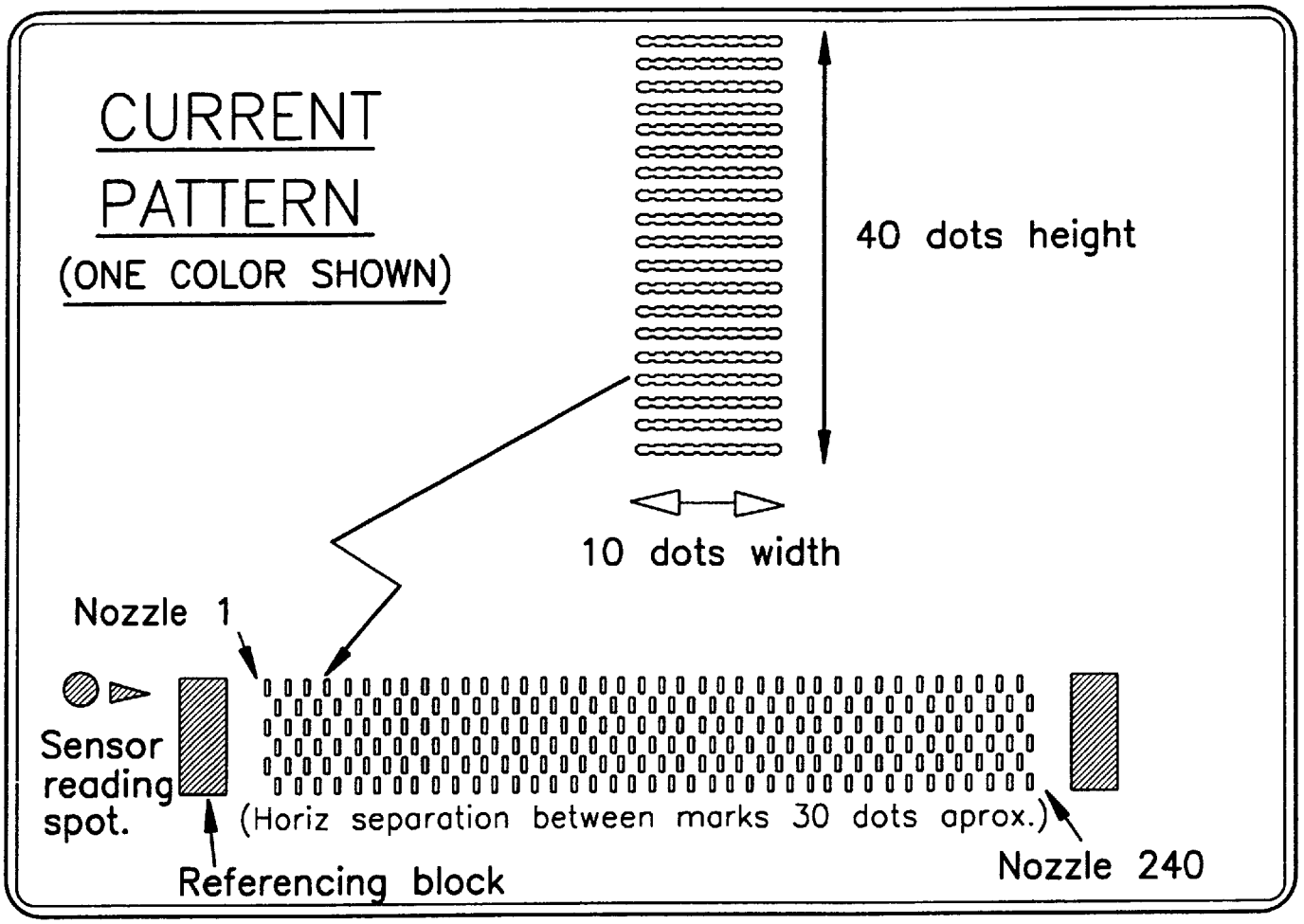
FIG. 12 shows a format for an exemplary test pattern of the present invention.
Figure 13:
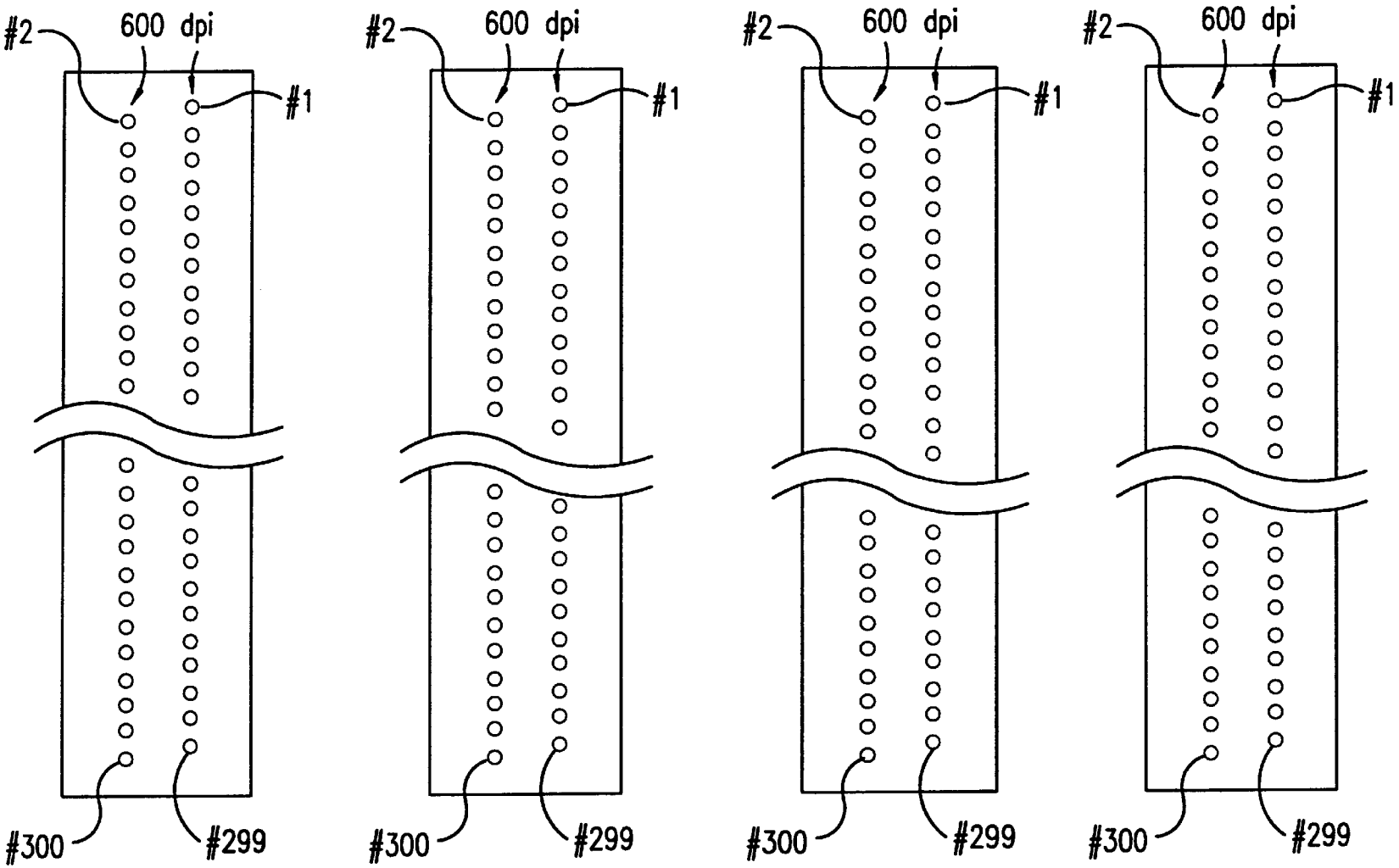
FIG. 13 is a schematic representation of four 600 dpi printheads in an aligned arrangement as used in a presently preferred printhead implementation.

FIG. 12 illustrates the layout and detailed specifications for a recent specific implementation of the present invention. The patterns have been successfully used with two hundred forty active nozzles on each of four 600 dpi printheads schematically shown in FIG. 13 in their aligned configuration on an inkjet printer carriage.

Although specific examples have been shown in the drawings and written description, it is to be understood by those skilled in the art that various changes and improvements can be made within the scope and spirit of the invention as set forth in the following claims.

We claim as our invention:

1. Apparatus for detection of any non-firing nozzle, in an inkjet printer that forms images on a printing medium; said apparatus comprising:

a scanning carriage with at least one printhead having multiple nozzles for firing inkdrops onto such medium to form such images;

an optical sensor for detecting presence or absence of ink drops on such medium;

a source of illumination for illuminating such printing medium and a multipass test pattern of ink drops on such medium;

the test pattern formed on such medium by the printhead nozzles and having multiple ink drops from substantially each single nozzle arrayed on generally adjacent pixels in a respective test group; and means for moving the optical sensor across said test group to identify and locate any non-firing nozzle.

2. The apparatus of claim 1, wherein:

said optical sensor is mounted on said scanning carriage.

3. The apparatus of claim 1, wherein:

said source of illumination is mounted on said scanning carriage.

4. The apparatus of claim 1, wherein:

said source of illumination includes at least two different colored light sources.

5. A method of determining nozzle-out functionality in an inkjet printer having a plurality of different nozzle groups, each group firing a different color ink said method comprising:

printing on a print medium a multipass test pattern from different nozzle groups, predetermined spaced apart portions of the test pattern being printed on generally adjacent pixels by different individual nozzles respectively;

shielding the test pattern from ambient light;

illuminating the test pattern with artificial light; and optically scanning across the portions of the test pattern during said shielding and illuminating steps to sense which portions have been printed satisfactorily by each of said different nozzles respectively in order to identify and locate any of said individual nozzles which are non-firing.

6. A printer for forming images on a printing medium; said printer comprising:

multiple nozzles for forming images by firing inkdrops in a pixel grid on such printing medium;

means in the printer for operating the nozzles to form on such printing medium a multipass test pattern comprising:

a multiplicity spaced apart of test-pattern modules in an array, each module corresponding to and formed substantially exclusively by a single respective one of the multiple nozzles, and each module occupying a respective multiplicity of generally adjacent pixels in the pixel grid.

7. The apparatus of claim 6, wherein:

each module occupies at least one respective multiplicity of substantially adjacent pixels in the pixel grid.

8. The printer of claim 7, further comprising:

a sensor system in the printer for reading substantially each module of the test pattern from such printing medium; and an evaluation system in the printer or in an associated printer driver for evaluating the read test pattern to detect any non-firing nozzles.

9. The printer of claim 6, further comprising:

a sensor system in the printer for reading the test pattern from such printing medium; and an evaluation system in the printer or in an associated printer driver for evaluating the read test pattern to detect any non-firing nozzles.

10. Apparatus for assessing nozzle ink ejection capability in an inkjet printer that has multiple nozzles and that prints in a pixel grid on a printing medium; said apparatus comprising:

a printer carriage for passing the multiple nozzles across the printing medium;

a test pattern formed on such printing medium by such printer carriage, said test pattern comprising:

a multiplicity of test-pattern modules in an array, each module corresponding to and formed substantially exclusively by a single respective one of the multiple nozzles, and each module occupying a respective multiplicity of generally adjacent pixels in the pixel grid; and a system for assessing the test pattern.

11. The apparatus of claim 10, wherein:

each module occupies at least one multiplicity of adjacent pixels in the pixel grid.

12. The apparatus of claim 11, wherein:

each module occupies a multiplicity of said multiplicities of adjacent pixels in the pixel grid, and said multiplicities of adjacent pixels are nearly contiguous with one another.

13. The apparatus of claim 12, wherein:

pairs of said multiplicities of adjacent pixels are spaced apart by only one blank row of pixels.

14. The apparatus of claim 10, wherein:

each module comprises a multiplicity of lines of adjacent pixels.

15. The apparatus of claim 14, wherein:

each module comprises at least twenty of said lines of adjacent pixels.

16. The apparatus of claim 15, wherein:

each of said lines comprises at least ten of said adjacent pixels.

17. The apparatus of claim 15, wherein:

pairs of said at least twenty lines of adjacent pixels are spaced apart by at least one blank row of pixels.

18. The apparatus of claim 10, wherein:

each module forms a spot large enough to be seen and assessed by the naked eye.

19. The apparatus of claim 18, wherein:

each spot is 1/60 by 1/15 inch or larger.

20. The apparatus of claim 10, further comprising:

a nozzle-control system in the printer for operating substantially all of the multiple nozzles to generate the test pattern on such printing medium; and instructions stored in the printer or in an associated printer driver for automatic operation of the nozzle-control system;

whereby the apparatus forms a substantially permanent visible record of performance of substantially every nozzle.

21. The apparatus of claim 20, wherein said assessing system comprises:

a sensor system in the printer for reading the test pattern from such printing medium;

an evaluation system in the printer or in an associated printer driver for evaluating the read test pattern; and instructions stored in the printer or in an associated printer driver for automatic operation of the sensor system and the evaluation system.

22. The apparatus of claim 10, wherein said assessing system comprises:

a sensor system in the printer for reading the test pattern from such printing medium;

an evaluation system in the printer or in an associated printer driver for measuring light contrast ratios from the read test pattern; and instructions stored in the printer or in an associated printer driver for automatic operation of the sensor system and the evaluation system;

whereby the apparatus provides a quantitative signal representing the firing of substantially every nozzle, based on said measured light contrast ratios.

23. The apparatus of claim 10, wherein:

substantially each of the modules is substantially discrete relative to substantially all the other modules.

24. The apparatus of claim 10, wherein:

the printer has no aperture plate for receiving ink to detect nozzle failure, and no auxiliary mechanical system for wiping received ink from the aperture plate.

* * * * *